US006981892B1

(12) United States Patent
Kostelnik

(10) Patent No.: US 6,981,892 B1
(45) Date of Patent: Jan. 3, 2006

(54) COMBINATION TELEPHONY AND CABLE JACK INTERFACE

(76) Inventor: Bradley D. Kostelnik, 2219 Eldridge Ave. East, North Saint Paul, MN (US) 55109

( * ) Notice: Subject to any disclaimer, the term of this patent is extended or adjusted under 35 U.S.C. 154(b) by 0 days.

(21) Appl. No.: 10/855,455

(22) Filed: May 28, 2004

(51) Int. Cl.
*H01R 13/60* (2006.01)
*H01R 13/66* (2006.01)

(52) U.S. Cl. ..... 439/536; 439/639

(58) Field of Classification Search ..... 439/536, 439/677, 639; 174/66
See application file for complete search history.

(56) References Cited

U.S. PATENT DOCUMENTS 4,655,529 A 4/1987 Yokoyama
5,114,365 A 5/1992 Thompson et al.
5,244,402 A * 9/1993 Pasterchick et al. ..... 439/217
5,401,192 A 3/1995 Briones et al.
6,222,124 B1 4/2001 Pritchard et al.
6,244,908 B1 * 6/2001 Hammond et al. ..... 439/676
6,297,450 B1 10/2001 Yu
D463,969 S 10/2002 Luu

* cited by examiner

*Primary Examiner*—Hae Moon Hyeon

(57) ABSTRACT

A combination phone and cable jack interface includes a base member, a faceplate, and a mechanism for selectively toggling a telephony jack connection between a telephony service provider and a cable service provider. The toggling mechanism includes a first port electrically coupled to a cable service provider network. A second port is electrically coupled to a telephony service provider network. The toggling mechanism further includes a jumper cable electrically coupled to the first port and removably connectable to the second port. The jumper cable includes a plurality of wires connected to a plurality of corresponding wires associated with the cable network. The jumper cable is disposed partially exterior of the base section so that a user can toggle the interface between cable and telephone modes.

3 Claims, 3 Drawing Sheets

COMBINATION TELEPHONY AND CABLE JACK INTERFACE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to telephone jacks and, more particularly, to a telephony and cable jack interface for allowing a user to switch telephony service between cable and telephony service providers without rewiring internal jack connections.

2. Prior Art

Telephony jacks are a common fixture in most homes and businesses for covering connections to telephony service providers mounted within walls. Such service providers often include local telephone or cable networks, which include distinct wiring for bringing a signal into a residence. The connections are made within the walls that are coupled to existing terminals provided by the telephony and cable companies. Open ends of the jacks are accessible through outlets formed therein for making the connections to the select networks. The outlets are provided on the outer surface of the wall plates and cover both the telephony and cable network terminals disposed in the walls.

As a result, similarly sized telephone jacks are used for both cable and telephony terminals. When a resident subscribes to their service provider of choice, they will receive telephone capabilities either through their local telephony company or local cable company. Of course, such service providers require different terminal connections to the telephone jacks, which must be activated through a telephony box or cable box located outside the residence.

For example, apartment buildings periodically acquire new tenants who may choose different service providers on a regular basis. Rewiring the existing phone jack to accommodate a new provider can result in substantial service fees to the consumer and is cumbersome because the consumer has to schedule an appointment with a technician and then take time off from work to meet the technician at the residence.

Accordingly, a need remains for an easy to use combination telephony and cable jack interface so that a user can convert from one service provider to another without rewiring the existing outlets.

BRIEF SUMMARY OF THE INVENTION

In view of the foregoing background, it is therefore an object of the present invention to provide a telephony and cable interface for eliminating the need to rewire connections when a user switches between a local telephone company and a cable company. These and other objects, features, and advantages of the invention are provided by a combination phone and cable jack interface including a base member having a substantially planar rear portion and a plurality of sidewalls integral therewith and extending orthogonally therefrom for defining a cavity therein.

The interface further includes a faceplate having substantially planar front and rear portions. The faceplate further has a perimeter equal to a perimeter of the base member for enclosing the cavity and a plurality of apertures formed therein for receiving fastening members therethrough so that the faceplate can be removably secured to the base member.

The interface further includes a mechanism for selectively toggling a telephony jack connection between a telephony service provider and a cable service provider so that a user can obtain telephony service from either service provider without needing to remove the jack from a wall outlet and internally rewiring the telephony jack connection.

The toggling mechanism includes a first port electrically coupled to a cable service provider network. The first port interfaces an external telephony line with the cable network. A second port is electrically coupled to a telephony service provider network for interfacing an external telephony line with a telephony network.

The toggling mechanism further includes a jumper cable electrically coupled to the first port and removably connectable to the second port wherein the external telephony line receives telecommunication signals from the telephony network when the jumper cable is electrically coupled to the second port. Alternately, the external telephony line receives telecommunication signals from the cable network when the jumper cable is removed from the second port. The jumper cable includes a plurality of wires connected to a plurality of corresponding wires associated with the cable network and is disposed partially exterior of the base section so that a user can readily toggle the interface between cable and telephony operating modes.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
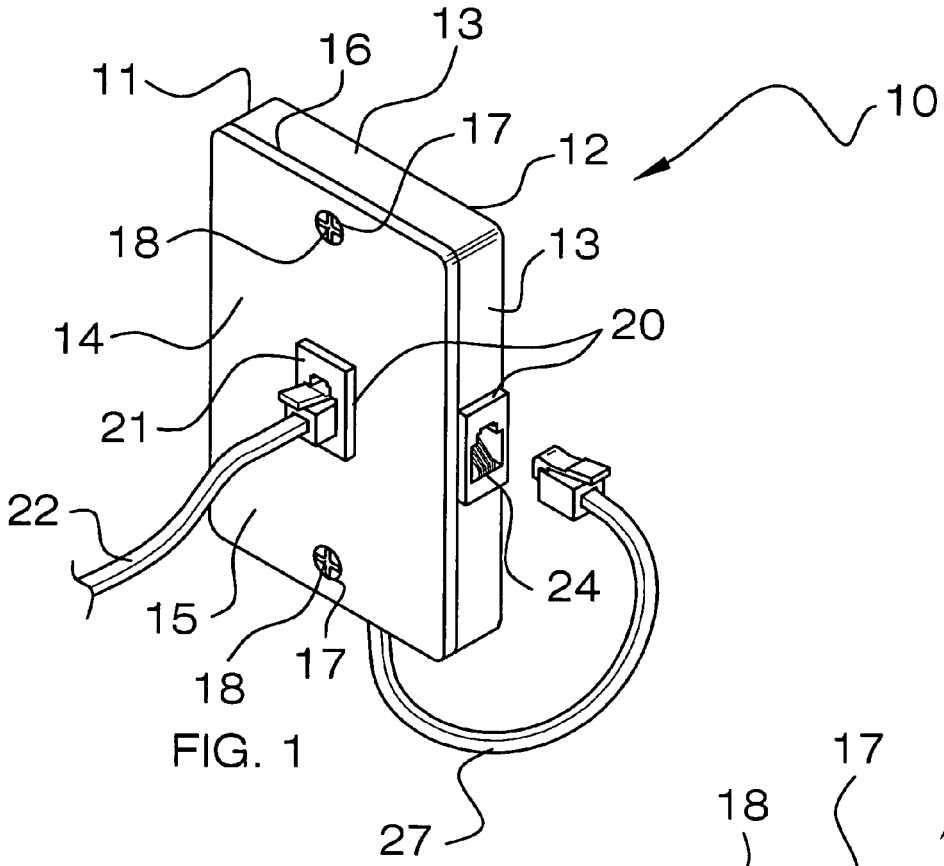
FIG. 1 is a perspective view showing a combination telephony jack and cable jack interface, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a combination telephony and cable jack interface. Initially referring to FIG. 1, the interface 10 includes a base member 11 having a substantially planar rear portion 12 and a plurality of sidewalls 13 integral therewith and extending orthogonally therefrom for defining a cavity therein.

The interface 10 further includes a faceplate 14 having substantially planar front 15 and rear 16 portions. The faceplate 14 further has a perimeter equal to a perimeter of the base member 11 for enclosing the cavity and a plurality of apertures 17 formed therein for receiving fastening members 18 therethrough so that the faceplate 14 can be removably secured to the base member 11. The faceplate 14 is easily removed by a user in the event internal repairs need to be made.

The interface 10 further includes a mechanism 20 for selectively toggling a telephony jack connection between a telephony service provider and a cable service provider so that a user can obtain telephony service from either service provider without needing to remove the jack from a wall outlet and internally rewiring the telephony jack connection. This enables a user to switch service providers without incurring substantial service costs associated with rewiring existing telephone service providers.

Figure 2:
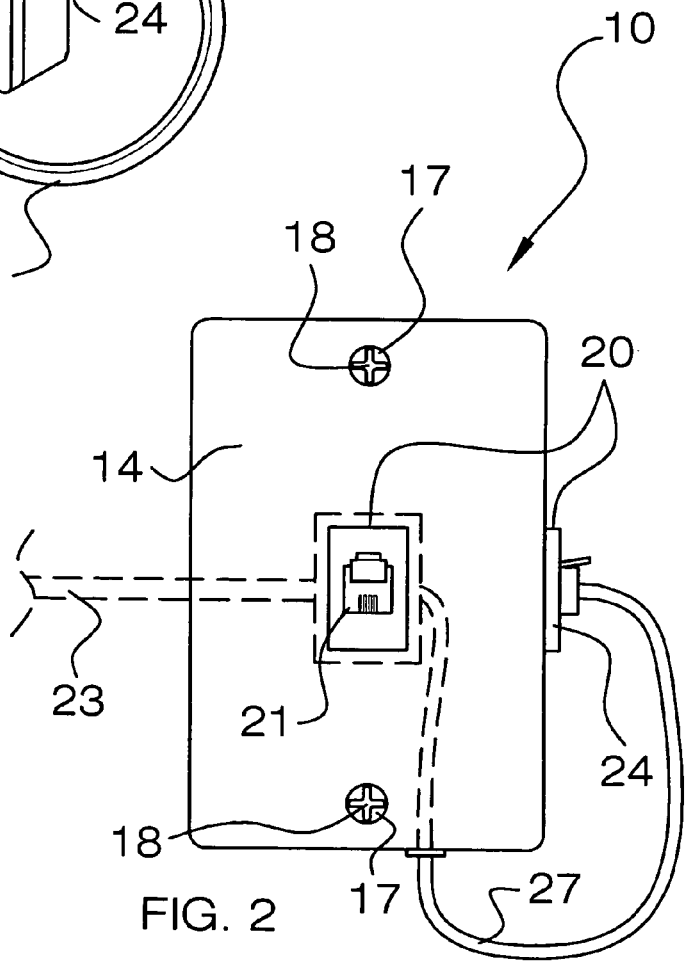
FIG. 2 is a front elevational view of the interface shown in FIG. 1.

Now referring to FIG. 2, the toggling mechanism 20 includes a first port 21 electrically coupled to a cable service provider network 23. The first port 21 interfaces an external telephony line 22 with the cable network 23. A second port 24 is electrically coupled to a telephony service provider network 25 for interfacing an external telephony line 22 with a telephony network 25.

Figure 3:
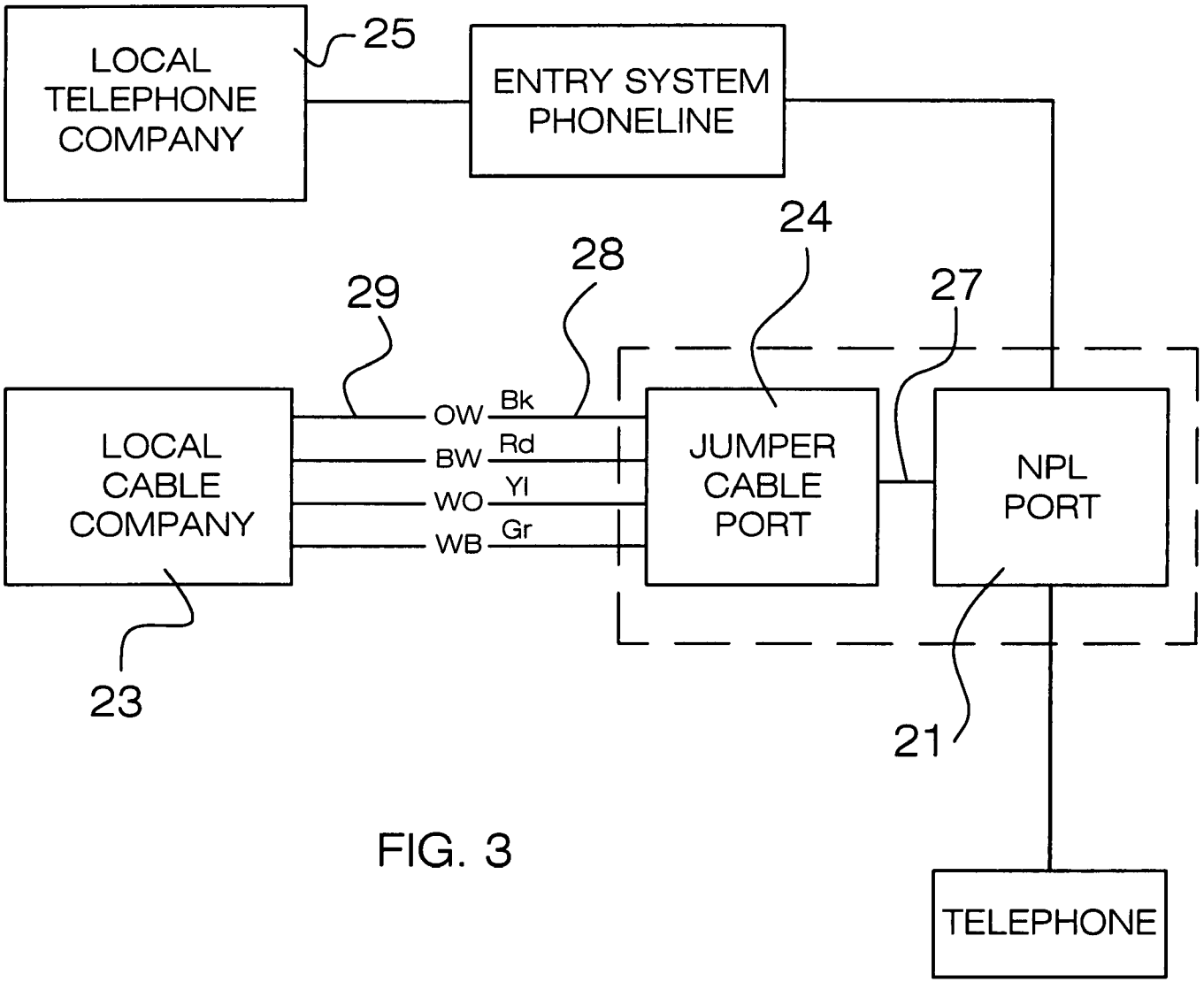
FIG. 3 is a schematic block diagram illustrating the connections between the present invention and a cable/telephony service provider.
Figure 4:
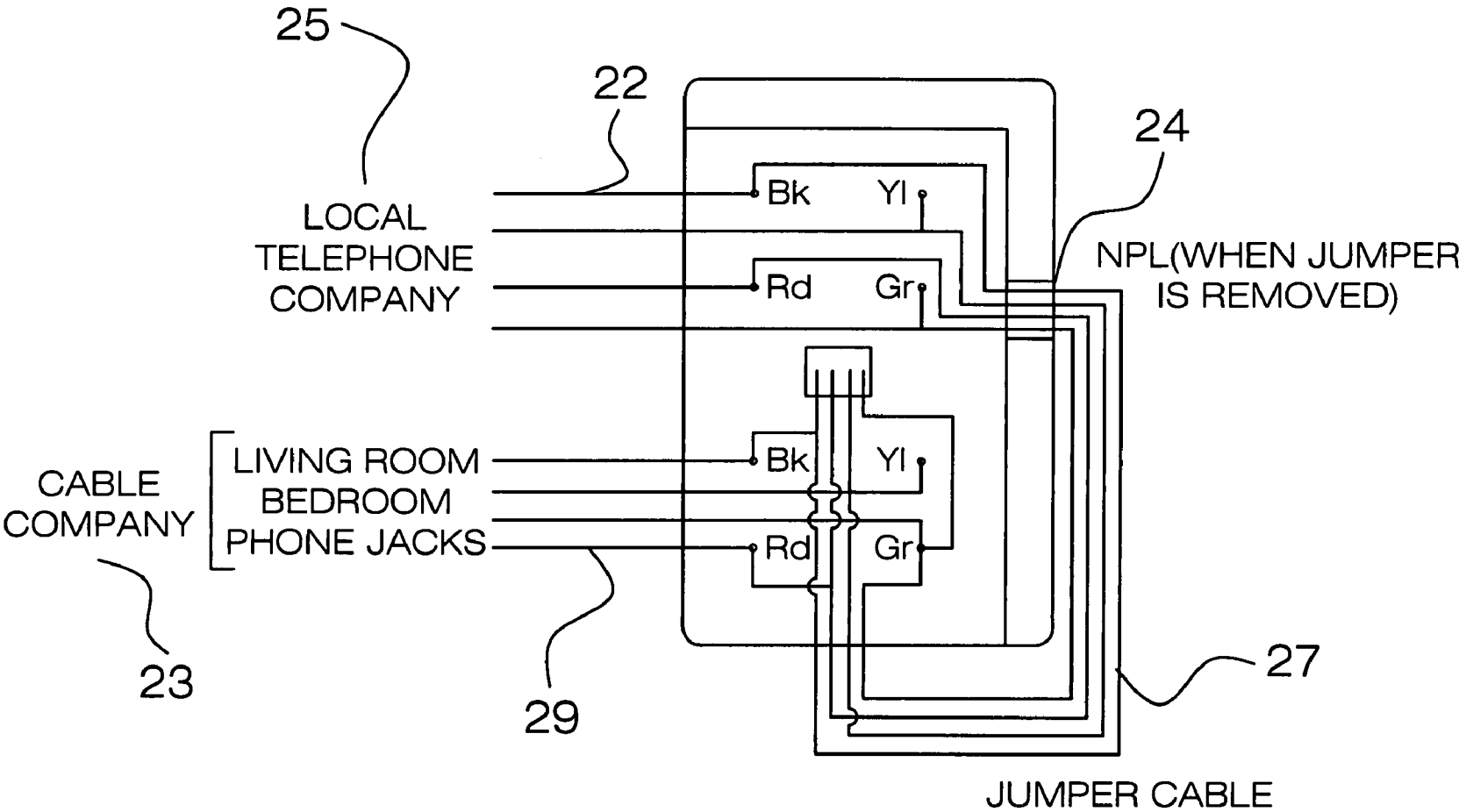
FIG. 4 is a schematic diagram illustrating the terminal connections between the present invention and a cable/telephony service provider.

Still referring to FIG. 2, the toggling mechanism 20 further includes a jumper cable 27 electrically coupled to the first port 21 and removably connectable to the second port 24 wherein the external telephony line 22 receives telecommunication signals from the telephony network 25 when the jumper cable 27 is electrically coupled to the second port 24, as shown in FIG. 3. The external telephony line 22 receives telecommunication signals from the cable network 23 when the jumper cable 27 is removed from the second port 24, as shown in FIG. 4.

Alternately, the jumper cable 27 includes a plurality of wires 28 connected to a plurality of corresponding wires 29 associated with the cable network 23. The jumper cable 27 is disposed partially exterior of the base member 11 so that a user can readily toggle the interface 10 between cable and telephony operating modes without having to remove the faceplate 14.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A combination phone and cable jack interface, said interface comprising:

a base member having a substantially planar rear portion and a plurality of sidewalls integral therewith and extending orthogonally therefrom, said base member defining a cavity therein;

a faceplate having substantially planar front and rear portions, said faceplate further having a perimeter equal to a perimeter of said base member for enclosing said cavity, said faceplate further having a plurality of apertures formed therein for receiving fastening members therethrough so that said faceplate can be removably secured to said base member; and means for selectively toggling a telephony jack connection between a telephony service provider and a cable service provider so that a user can obtain telephony service from either service provider without needing to remove said jack from a wall outlet and internally rewiring the telephony jack connection, said toggling means comprising a first port electrically coupled to a cable service provider network, said first port for interfacing an external telephony line with the cable network, a second port electrically coupled to a telephony service provider network, said second port for interfacing an external telephony line with a telephony network, and a jumper cable electrically coupled to said first port and being removably connectable to said second port wherein the external telephony line receives telecommunication signals from the telephony network when said jumper cable is electrically coupled to said second port and receives telecommunication signals from the cable network when said jumper cable is removed from said second port.

2. The interface of claim 1, wherein said jumper cable comprises: a plurality of wires connected to a plurality of corresponding wires associated with the cable network.

3. The interface of claim 1, wherein said jumper cable is disposed partially exterior of said base section so that a user can readily toggle said interface between cable and telephony operating modes.

* * * * *